US007998097B2

(12) United States Patent
Gueret

(10) Patent No.: US 7,998,097 B2
(45) Date of Patent: Aug. 16, 2011

(54) MASSAGE DEVICE INCLUDING AT LEAST TWO ROTARY ANNULAR LIPS AND METHOD USING SAME

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 1327 days.

(21) Appl. No.: 11/546,369

(22) Filed: Oct. 12, 2006

(65) Prior Publication Data

US 2007/0135741 A1 Jun. 14, 2007

Related U.S. Application Data

(60) Provisional application No. 60/731,230, filed on Oct. 31, 2005.

(30) Foreign Application Priority Data

Oct. 12, 2005 (FR) ..... 05 53108

(51) Int. Cl.
*A61H 15/00* (2006.01)

(52) U.S. Cl. ..... 601/123; 601/119; 601/122

(58) Field of Classification Search ..... 601/112, 601/113, 118, 119, 120, 122, 123, 125, 127, 601/129, 131, 134–137
See application file for complete search history.

(56) References Cited

U.S. PATENT DOCUMENTS

| | | | | |
|---|---|---|---|---|
| 1,958,936 | A | 5/1934 | Bajette et al. | |
| 1,999,939 | A * | 4/1935 | Luzzi | 601/125 |
| 2,691,978 | A | 10/1954 | Kirby | |
| 4,326,508 | A * | 4/1982 | Stauffer | 601/129 |
| 5,218,955 | A | 6/1993 | Gueret | |
| 2005/0020948 | A1 | 1/2005 | Gueret | |

FOREIGN PATENT DOCUMENTS

| | | |
|---|---|---|
| FR | 1 093 828 | 5/1955 |
| FR | 2 480 118 | 10/1981 |
| GB | 519875 | 4/1940 |
| GB | 880289 | 10/1961 |
| JP | A 2005-13685 | 1/2005 |

* cited by examiner

*Primary Examiner* — Quang D Thanh
(74) *Attorney, Agent, or Firm* — Oliff & Berridge, PLC

(57) ABSTRACT

A massage device may include: at least one support; and one or more massage members rotatably mounted on the support. The or each massage member may include at least one pair of flexible lips. Each lip may extend about an axis of rotation of the massage member, may be configured to come into engagement with a region to be treated, and may be configured to flex when the device is applied to the region to be treated.

40 Claims, 11 Drawing Sheets

MASSAGE DEVICE INCLUDING AT LEAST TWO ROTARY ANNULAR LIPS AND METHOD USING SAME

CROSS-REFERENCE TO RELATED APPLICATION

This non provisional application claims the benefit of French Application No. 05 53108 filed on Oct. 12, 2005 and U.S. Provisional Application No. 60/731,230 filed on Oct. 31, 2005, the entire disclosures of which are incorporated herein by reference.

The present invention relates to massage devices.

BACKGROUND

There exist applicators that comprise a rigid flat roller that is provided with spikes on the outside for massaging the face.

There also exist applicators that are formed by a handle and by a rigid disk, or by two rigid disks, that roll over the epidermis without creating tensioning action on the skin.

U.S. Pat. No. 5,218,955 discloses a massage device including rotary massage members.

U.S. Patent Application Publication No. 2005/0020948 discloses a massage device comprising at least one massage member secured to a receptacle.

SUMMARY

Applicators with spikes are on the outside of a rigid roller not adapted to the local treatment of deep wrinkles, since they are relatively aggressive to the skin, and are often too bulky. Applicators that do not create tensioning action on the skin are not very effective for treating wrinkles or for activating microcirculation of the blood. Thus, there exists a need to benefit from a massage device that is not very aggressive to the skin, and/or that enables the epidermis to be treated in such a manner as to activate blood microcirculation and/or perform lymphatic drainage and/or fight against aging of the skin and/or encourage the penetration or action of active ingredients and/or obtain a relaxing action.

Exemplary embodiments of the invention may provide a massage device comprising: at least one support; and one or more massage members rotatably mounted on the support, the or each massage member comprising at least one pair of flexible lips configured to come into engagement with the region to be treated, and being configured to flex when the device is applied to the region to be treated.

Each of the flexible lips may extend about the axis of rotation of the corresponding massage member.

A gap situated between the lips may be permanently in communication with the outside, including during use.

For example, the region to be treated may be the skin on the face or the body, or the scalp, or the hair.

When applied to the skin, the flexible lips may exert local tension on the skin. Rolling the flexible lips over the skin may makemay make it possible to displace the tension exerted on the skin.

may makeExemplary embodiments may make it possible to make a massage member for the face that may be capable of massaging the skin without leaving red marks, for example.

The pair of flexible lips may belong to a single massage member, and the flexible lips may be molded as a single part with the massage member. The lips may form between them an annular groove that does not create suction on being applied to the skin, unlike a suction pad. The two flexible lips need not be molded as a single part, and may belong to different massage members.

The massage member may include at least one pin portion that is molded together with the flexible lips. This may makemay make it possible to reduce the number of component parts of the massage device, where appropriate or desired.

The massage member may include a hub that is made of a material that is different from the material of the lips. Such a hub may makemay make it easier for the massage member to turn, where appropriate or desired.

The massage device may possibly include projecting elements between the lips, for example, a succession of spikes, which projecting elements may be made integrally, i.e., monolithically, with the flexible lips, where appropriate or desired. The projecting elements may generate vibration while being displaced in contact with the skin.

The flexible lips may flare apart from each other, going away from the axis of rotation, which may enable the lips to flex apart more easily while the massage member is being applied to and pressed against the skin.

The flexible lips may include an edge that is circular or otherwise, for example, polygonal, and may include an annular shape.

The flexible lips may include openings, which may increase flexibility thereof.

The flexible lips may include notches or teeth on an edge thereof.

The lips may define between them a groove that widens in a radial direction.

The flexible lips of the pair of flexible lips may be substantially symmetrical to each other about a plane that is perpendicular to the axis of rotation.

The free edge of each flexible lip may optionally include axial symmetry about the axis of rotation.

At least one flexible lip may be off-center.

The distance, measured along the axis of rotation, between the free edges of the two flexible lips of the pair of flexible lips may lie in a range of 1 millimeter (mm) to 15 mm, for example, for example, lying in a range of 2 mm to 10 mm, for example.

A length of the flexible lips, measured between the free edge and a zone at which the lips connect with a remainder of the massage member, may lie in a range 3 mm to 15 mm, for example, for example, lying in a range 4 mm to 10 mm, for example.

A thickness of a flexible lip may be not greater than 1.5 mm, for example.

A material from which the flexible lips are made may contain a filler of magnetic particles, where appropriate or desired.

A maximum radius of a flexible lip may be not greater than 20 mm, for example.

The device may include at least one additional rotary massage member that may be configured to come into contact with the skin while the flexible lips are being deformed in contact with the skin.

The additional massage member may be mounted between branches of the support, with each branch supporting one of the massage members.

For example, the rotary member may be a roller disposed between the branches.

The roller may include portions in relief, making it possible to create a complementary massage action, for example, spikes or ribs that are angularly offset going from one end of the roller to the other.

The support may include a flat handle.

The device may include at least one slotted pin on which there is snap-fastened a rotary ring that carries a massage member. The pin may be fitted on the support.

Exemplary embodiments of the invention may provide a method of massaging the skin using a device as defined above. The flexible lips may be applied to the skin, for example, on either side of a wrinkle, and the massage member (s) may be turned by being rolled over the skin.

Tension may be exerted by applying the massage device on either side of at least one wrinkle.

The massage device may be displaced along the wrinkle.

A composition may be deposited between the flexible lips prior to and/or during displacement of the massage member (s) over the skin.

BRIEF DESCRIPTION OF THE DRAWINGS

Various details of the present invention may will be better understood on reading the following detailed description of non-limiting embodiments, and on examining the accompanying drawings, in which.

DETAILED DESCRIPTION OF EMBODIMENTS

Figure 1:
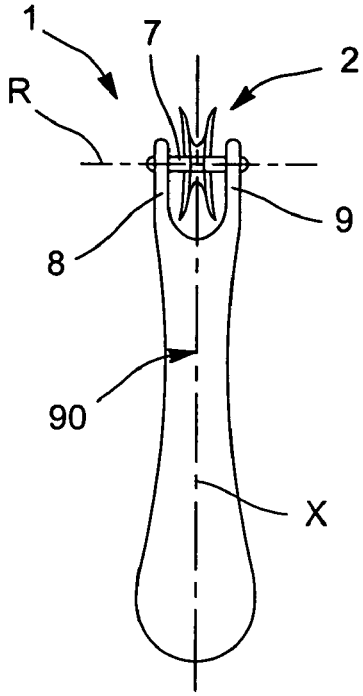
FIG. 1 is an elevation view of an exemplary massage device.

The massage device 1 illustrated in FIG. 1 may comprise a massage member 2 that is capable of turning about an axis of rotation R relative to a support 90, which may be elongate along a longitudinal axis X.

For example, the axes X and R may be substantially orthogonal.

Figure 2:
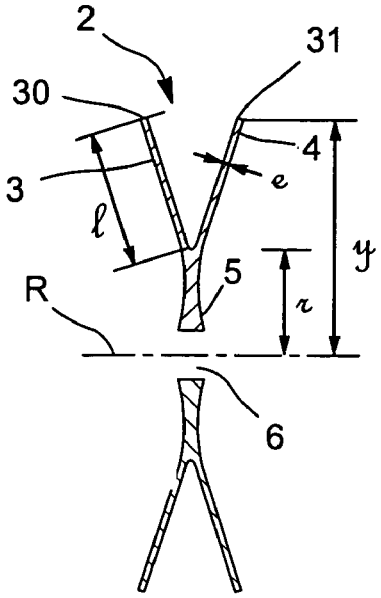
FIG. 2 is an axial cross-sectional view of the massage member of FIG. 1.

The massage member 2, illustrated in isolation in FIG. 2, may comprise a pair of flexible lips 3 and 4 configured to come into contact with the skin while the device 1 is being used.

The lips 3 and 4 may be connected to a central portion 5, that may include an opening 6 passing therethrough, through which may pass a pin 7 including ends that are held by two branches 8 and 9 of the support 3.

Figure 3:
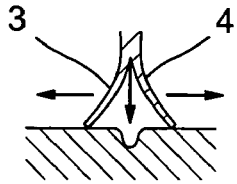
FIG. 3 illustrates how the flexible lips may deform in contact with the skin.

At rest, the lips 3 and 4 may flare apart from each other in the radial direction, such that when the massage member 2 is applied against the skin, and pressure is exerted by the massage member on the skin in a direction that is generally perpendicular to the axis of rotation R, the lips 3 and 4 may tend to exert an action of spreading out the epidermis, as illustrated in FIG. 3. This spreading action may be exerted on either side of a wrinkle F, for example, and may makemay make it possible to tighten the skin around the wrinkle.

For example, the device 1 may be displaced along the wrinkle F, with the lips 3 and 4 being applied to the skin on either side of the wrinkle.

As illustrated in FIG. 2, the flexible lips 3 and 4 are made integrally, i.e., monolithically, with the central portion 5 by molding a plastics material, for example, an elastomer material.

Figure 4:
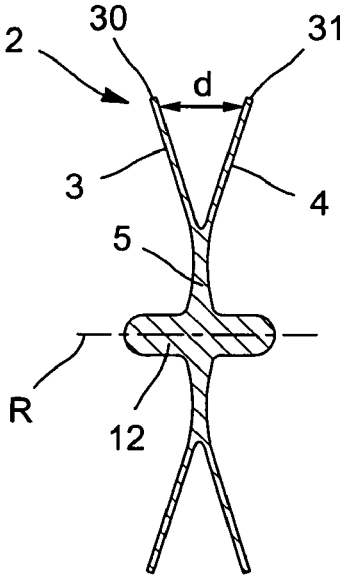
FIGS. 4 to 8 are views similar to FIG. 2 illustrating exemplary massage members.

As illustrated in FIG. 4, the flexible lips 3 and 4 may also be made of a material that may be different from the central portion 5, for example, by overmolding an elastomer material on the central portion 5, the central portion being molded from a plastics material that is more rigid than the lips 3 and 4. This may makemay make it easier for the massage member 2 to turn.

As illustrated in FIG. 4, the central portion 5 may possibly be made with pin portions 12 of axis R, thereby avoiding the need for a pin 7. The pin portions 12 may be received directly in housings in the branches 8 and 9, where appropriate or desired.

Figure 5:
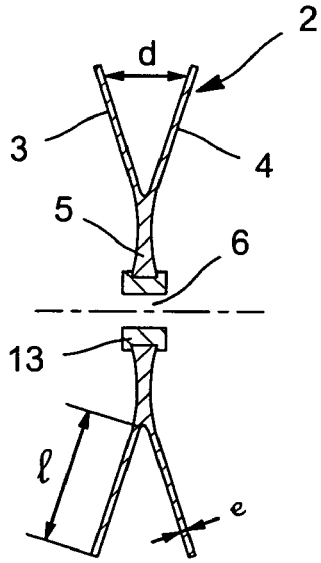

As illustrated in FIG. 5, the massage member 2 nay include a hub 13 that is made of a material that is different from the material from which the flexible lips 3 and 4 are made, for example, a plastics material that is more rigid.

The hub 13 may be fitted in the opening 6 of the central portion 5, for example, being snap-fastened on the central portion.

Figure 6:
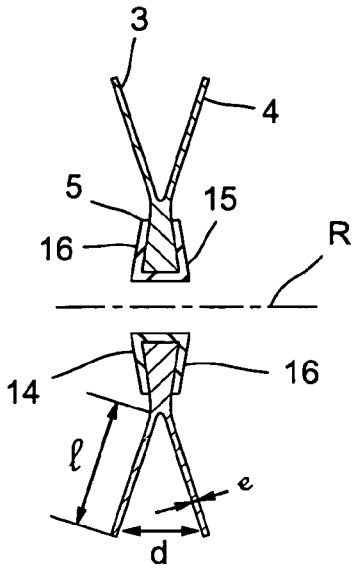

The hub 13 may also be overmolded on the central portion 5.

Where appropriate or desired, the hub 13 may comprise two parts 14 and 15 that may be assembled together, as illustrated in FIG. 6. This may make it possible, for example, to make the parts 14 and 15 with flanges 16, seeking to stiffen the central portion 5. The parts 14 and 15 may be assembled together by snap-fastening, for example, but maymay be fastened in some other way, for example, using adhesive or heat-sealing, amongst other things.

Figure 7:
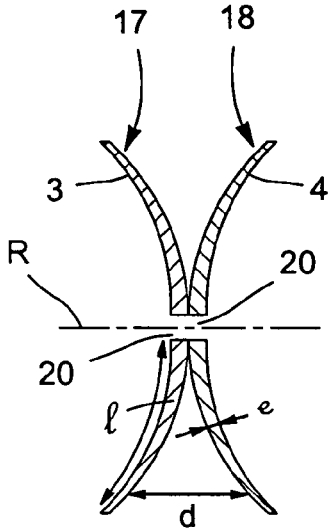

The flexible lips 3 and 4 may be made integrally, i.e., monolithically, by molding a plastics material, as illustrated in FIGS. 2 to 6, but it is contemplated that the flexible lips 3 and 4 may be two independent parts, as illustrated in FIG. 7.

For example, the lips 3 and 4 may belong to respective massage members 17 and 18 that include a shape that may be generally outwardly-concave, including an opening 20 passing therethrough, through which a pin may pass.

The concave sides of the massage members 17 and 18 may face away from each other, but maymay face each other in other exemplary embodiments that are not illustrated.

Figure 8:
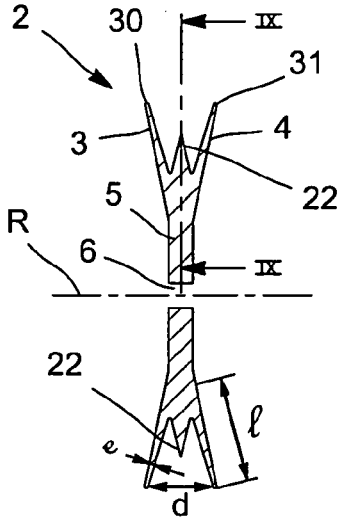

As illustrated in FIG. 8, the massage member 2 may include projecting elements 22 between the flexible lips 3 and 4.

Figure 9:
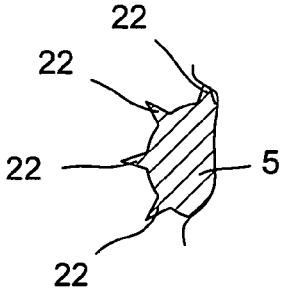
FIG. 9 is a cross-sectional view taken along IX-IX of FIG. 8.

For example, the projecting elements 22 may be disposed in a spaced-apart manner over a circumference of the central portion 5, between the flexible lips 3 and 4, as illustrated in FIG. 9.

Figure 10:
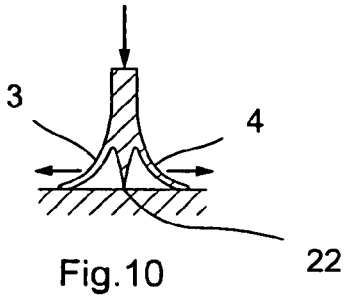
FIG. 10 illustrates how the flexible lips may deform in contact with the skin.
Figure 12:
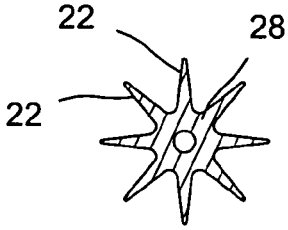
FIG. 12 is a diagrammatic cross-sectional view taken along XII-XII of FIG. 11.

A height of the projecting elements 22, that may be in the form of spikes, for example, may be less than a height of the flexible lips 3 and 4, such that the projecting elements 22 only come into contact with the skin after the flexible lips 3 and 4 have moved apart, as illustrated in FIG. 10.

In axial cross-section, the lips 3 and 4 may be substantially rectilinear over at least a fraction of their length, for example, a fraction of their length starting from their free edge 30 or 31. The axial section of the lips 3 and 4 may also be curvilinear.

As illustrated in FIG. 8, the projecting elements 22 may be made integrally, i.e., monolithically, with the flexible lips 3 and 4 by molding.

Figure 11:
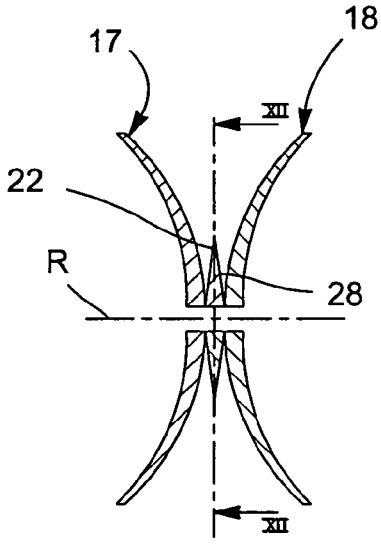
FIG. 11 is a view similar to FIG. 2 illustrating another exemplary embodiment.

As illustrated in FIG. 11, the projecting elements 22 may be carried by a rotary part 28 that is interposed between the massage members 17 and 18.

The flexible lips 3 and 4 may be symmetrical to each other about a mid-plane that is perpendicular to the axis R, for example, like the massage member illustrated in FIG. 2.

Figure 13:
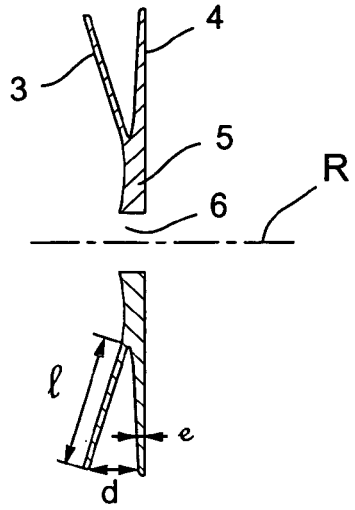
FIGS. 13 to 16 are other views similar to FIG. 1 illustrating exemplary embodiments.

This maymay be otherwise, and it is possible, for example, to include flexible lips 3 and 4 that may be not symmetrical to each other about a mid-plane that is perpendicular to the axis R, as illustrated in FIG. 13.

For example, the flexible lip 4 may extend substantially in a plane that is substantially perpendicular to the axis R, while the flexible lip 3 slopes relative to the axis R, going away from the lip 4 in the radial direction, for example.

Figure 14:
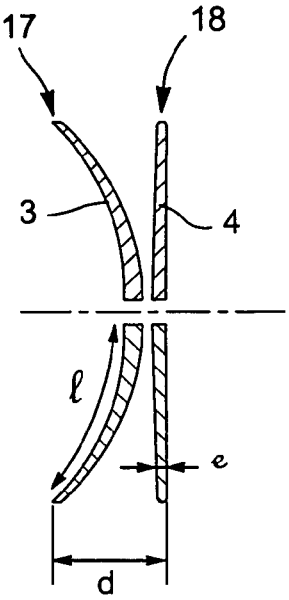

When the flexible lips 3 and 4 are defined by different massage members 17 and 18, they may also include different shapes, as illustrated in FIG. 14.

The flexible lips 3 and 4 may be made in some other way, so as to include different flexibilities.

Figure 15:
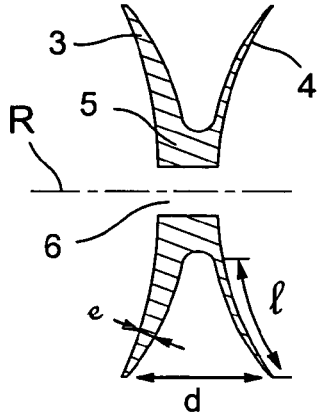

For example, the flexible lip 3 may be made from a material that is thicker than the flexible lip 4, so as to deform less easily, as illustrated in FIG. 15.

Each of the respective free edges 30 and 31 of the flexible lips 3 and 4 may be circular, for example. For example, the edges 30 and 31 may include the same radius or different radii. A maximum radius y, i.e., the distance to the axis R from the edge 30 or 31, may be not greater than 20 mm, for example.

Each edge 30 or 31 may be contained in a plane, but this may be different. For example, the edge 30 or 31 may extend in an undulating manner on either side of a mid-plane that is perpendicular to the axis R, as illustrated in FIG. 17A.

The flexible lips 3 and 4 may include a length l, measured between the corresponding free edge 30 or 31 and the central portion 5, that may be greater over at least a fraction of the circumference of the lip, for example, over the entire circumference, than the radius of the central portion 5, as illustrated in FIG. 2.

The lengths l may be identical for each of the flexible lips 3 and 4, or may be different.

Figure 16:
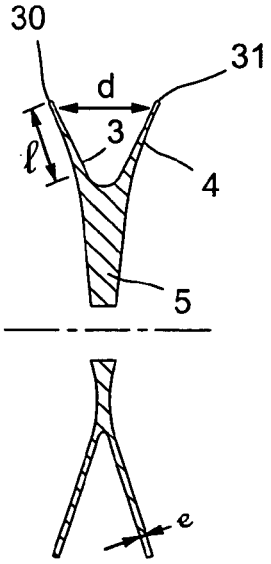

The length l may vary in the circumferential direction, as illustrated in FIG. 16, in such a manner as to cause the distance d between the free edges 30 or 31 in the circumferential direction to vary, for example, and/or to cause the flexibility of the lips 3 and 4 in the circumferential direction to vary.

The length l may lie in a range of 3 mm to 15 mm, for example, or even 3 mm to 10 mm.

The distance e may lie in a range of 1 mm to 15 mm, for example, or even 1 mm to 6 mm.

For example, the thickness of a lip 3 or 4 may be not greater than 1.5 mm over at least half of its length, for example.

Figure 17:
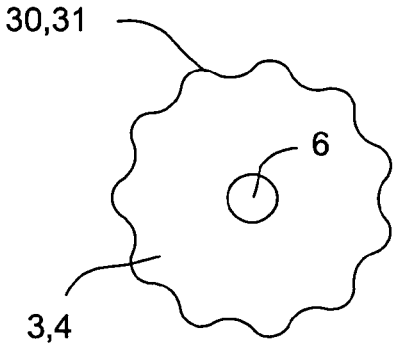
FIGS. 17 and 18 are front views illustrating exemplary massage members in isolation.
Figure 17A:
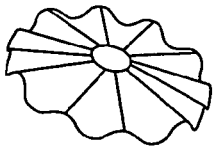
FIGS. 17*a* and 19 are fragmentary, perspective views illustrating exemplary massage members.

The free edge 30 or 31 may also include a non-circular shape, for example, an undulating shape, as illustrated in FIG. 17. An amplitude of the undulations in a measured radial direction may be not greater than 5.

Figure 18:
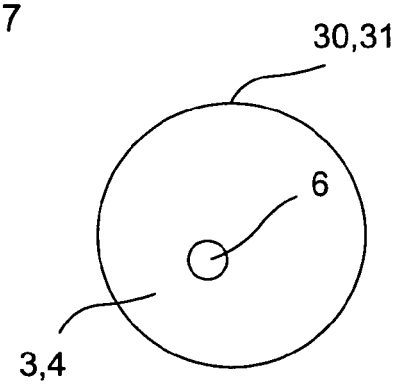

The opening 6 may be off-center, as illustrated in FIG. 18.

Figure 19:
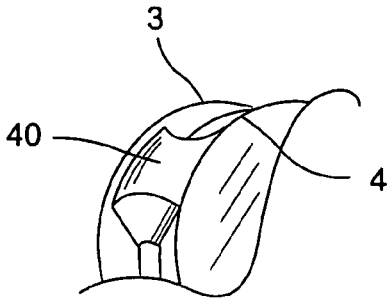

The lips 3 and 4 may be connected together via at least one bridge of material 40 that is of limited angular extent, as illustrated in FIG. 19. The may make it possible to secure the lips and/or to stiffen the lips locally.

Figure 20:
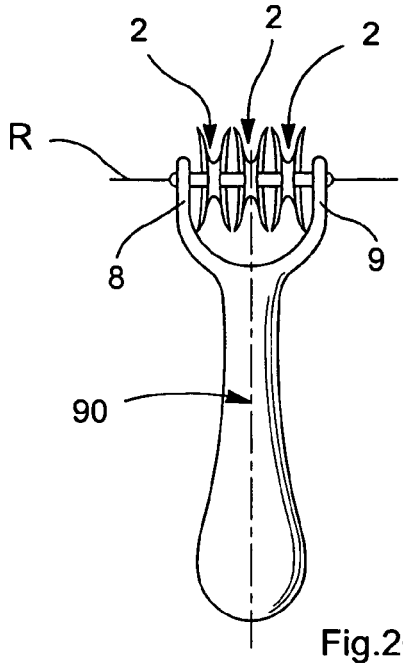
FIGS. 20 and 21 are elevation views of exemplary devices.

A plurality of identical or different massage members 3 may be rotatably mounted on a common support 90, as illustrated in FIG. 20, for example, turning about a single axis of rotation R.

Figure 22:
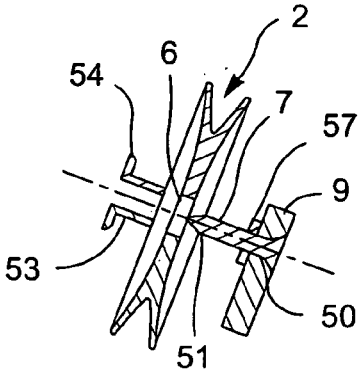
FIG. 22 is an exploded longitudinal cross-sectional view illustrating a detail of the device of FIG. 21.
Figure 21:
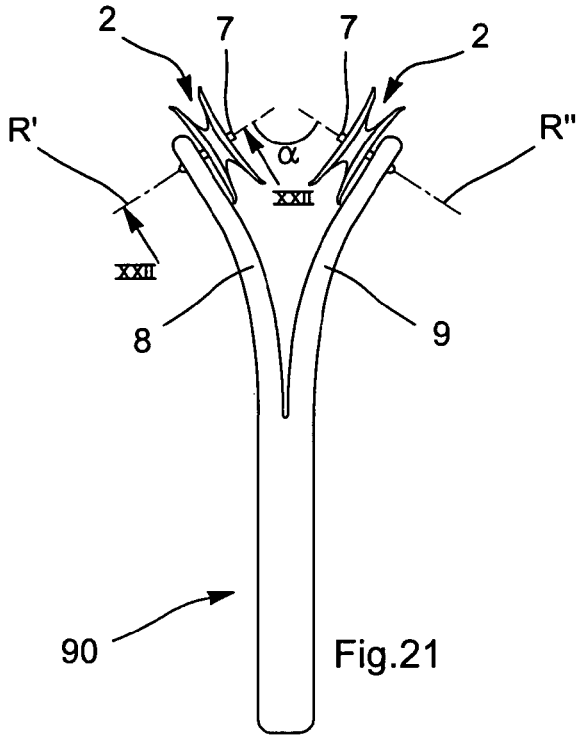

In other exemplary embodiments, at least two massage members 2 may be rotatably mounted about respective axes of rotation R' and R", forming an angle $\alpha$ between them, which angle may be less than 180°, for example, as illustrated in FIG. 21, or greater than 180°, as illustrated in FIG. 22. As illustrated in FIG. 22, the massage members 2 may include a V-shaped configuration that is upsidedown relative to the handle of the support 90.

Figure 23:
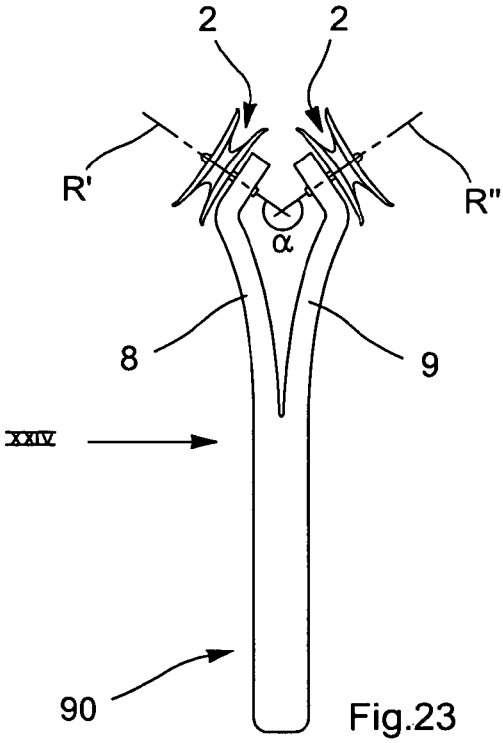
FIG. 23 is a view similar to FIG. 21 illustrating another exemplary embodiment.

For example, the massage members 2 may be cantilevered on the respective pins, as illustrated in FIGS. 21 and 23.

For example, a massage member as illustrated in FIGS. 21 and 23 may be fastened, as illustrated in FIG. 22, by a pin 7 including one end that is snap riveted in a housing 50 of a branch, and an opposite end that includes a wide slotted head 51, enabling a retention sleeve 53 to be snap-fastened on the pin 7. The retention sleeve may be provided with a collar 54 that may be used to hold the massage member 2 on the pin 7. The pin may include a collar 57 that comes to bear against the corresponding branch.

Figure 24:
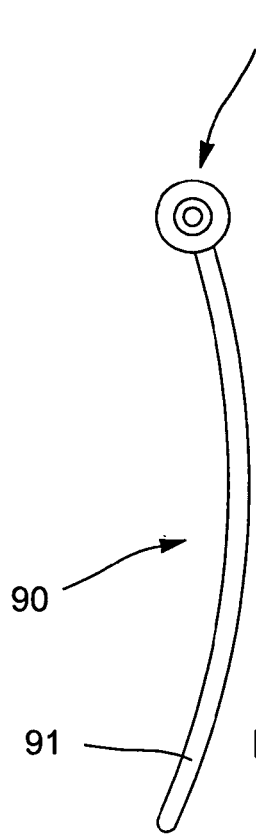
FIG. 24 is a side view as seen looking along XXIV of FIG. 23.

The support 90 may include a generally curved shape, as illustrated in FIG. 24.

Over at least a fraction of their length, the branches may be preferably deformed in one or more directions as a function of their cross-section, which need not be circular.

The massage device illustrated in FIGS. 21 and 23 advantageously may include branches 8 and 9 that may be flexible enough to be able to deform during use. This may make it easier for the massage device to match the shape of the region to be treated, for example. For example, at least one of the branches 8 and 9 may be elastically deformable, and may be deformed in any direction. Preferably, both branches may be elastically deformable.

The length of the branches may be not less than 40 mm, for example.

Figure 25:
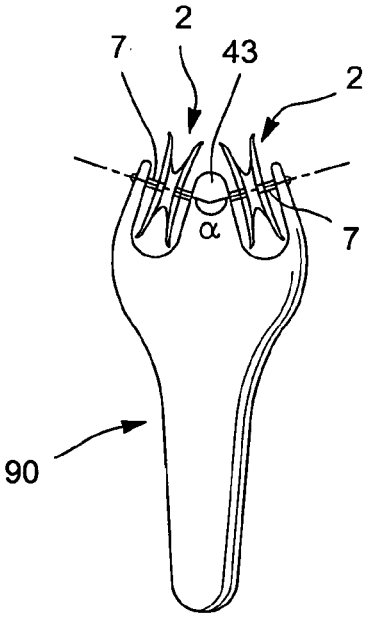

FIG. 25 illustrates an exemplary embodiment in which the massage members 2 are carried by respective pins 7 that are supported at both their ends by the support 90, the support including an intermediate portion 43 that is situated between the massage members 2.

Figure 26:
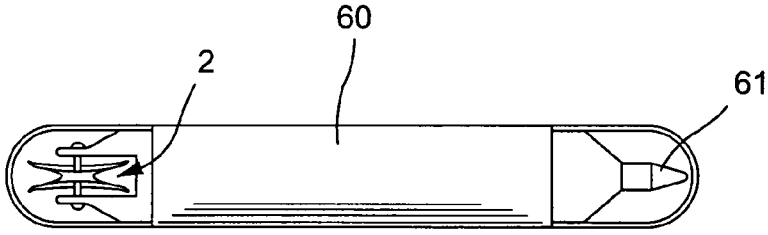
FIGS. 25 to 32 and 34 are elevation views of other exemplary devices.

At least one massage member 2 may also be secured to a receptacle 60, as illustrated for example, in FIG. 26, for example, being present at one end of the receptacle, while the other end carries an applicator member 61, for example, a tip or any other means for applying or dispensing a composition, such as a simple dispenser orifice, or a pump, or a ball held in a cage as with a roll-on dispenser, for example.

Figure 27:
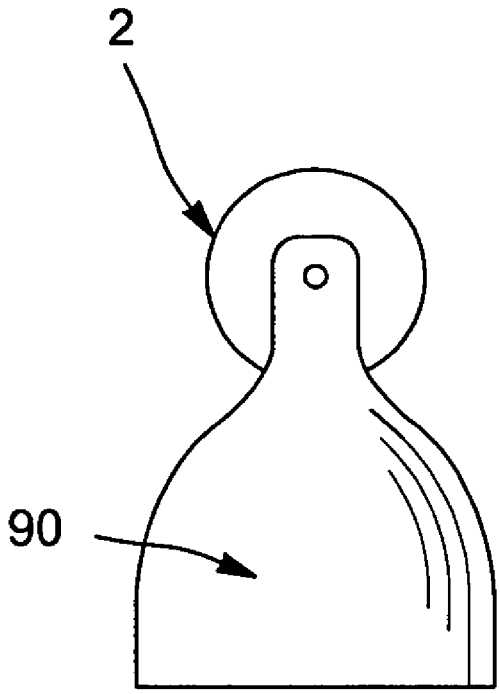
Figure 27:
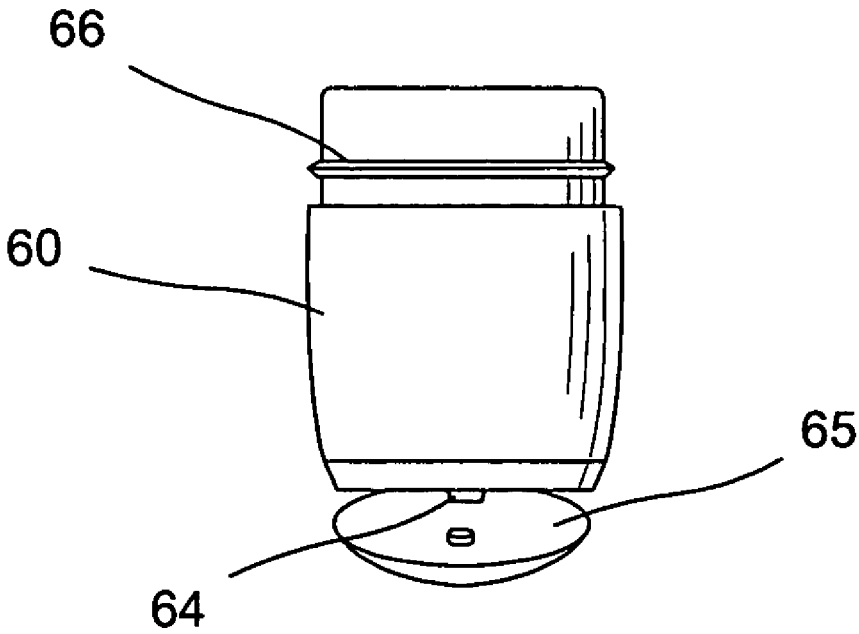

As illustrated in FIG. 27, one end of the receptacle 60 includes a dispenser orifice 64 that may be closed by a cap 65.

The support 90 may be configured to be fastened on the receptacle 60 on the side remote from the dispenser orifice 64. To this end, the receptacle 60 may include a portion in relief 66, for example.

Figure 28:
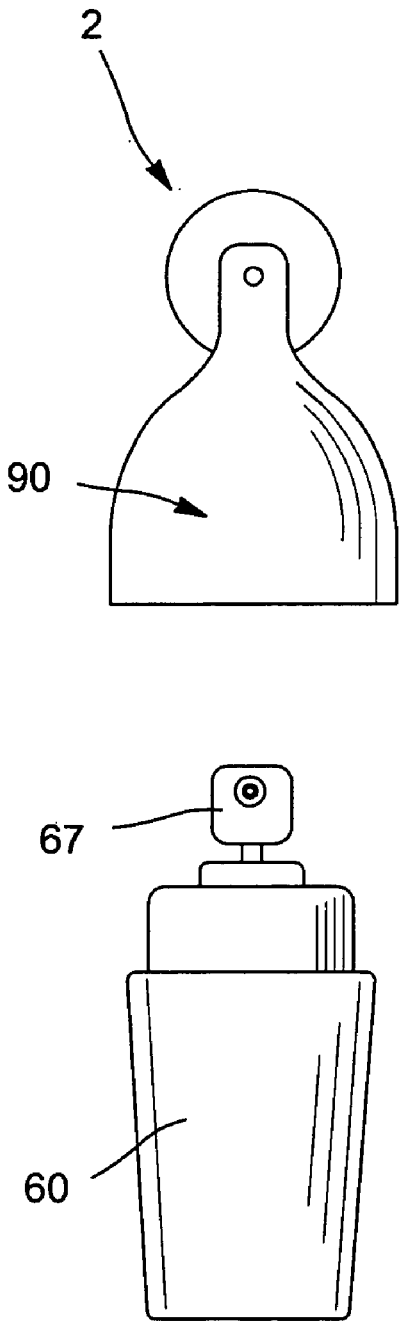

As illustrated in FIG. 28, the receptacle 60 may be fitted with a dispenser member 67, such as a pump, for example, and the support 90 may be configured as a cap that is suitable for covering the dispenser member 67 while not in use.

Figure 29:
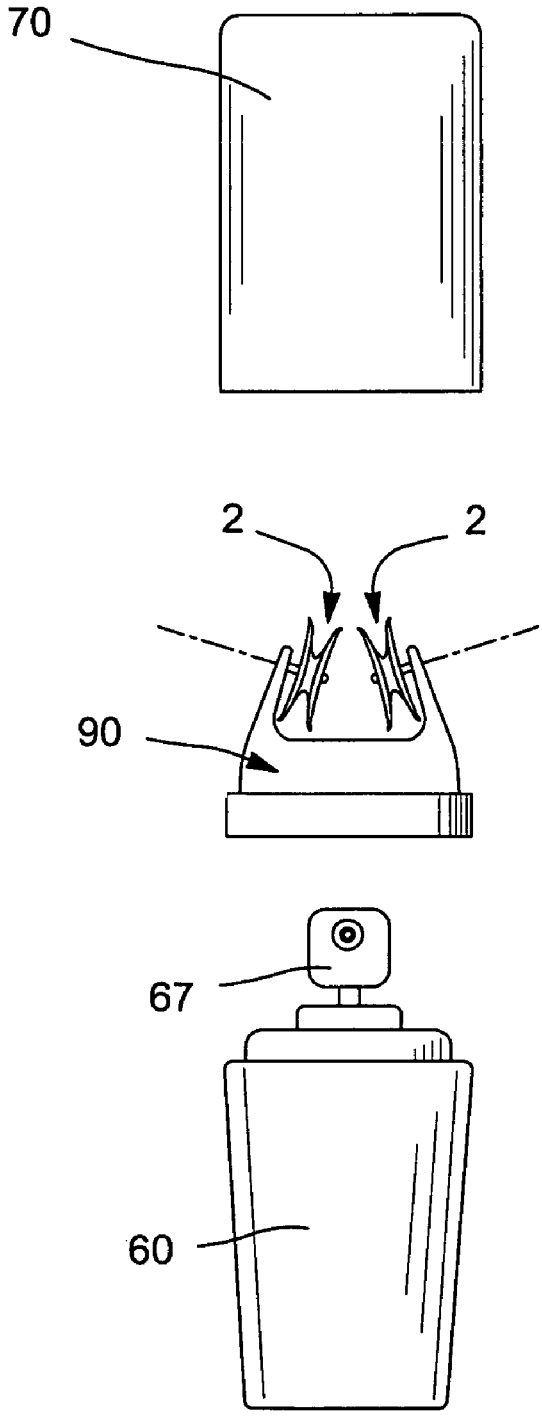

As illustrated in FIG. 29, the support 90 may be configured to be fastened on the receptacle 60, in such a manner as to cover the dispenser member 67. The support may be also arranged in such a manner that the support itself may be covered by a protective cap 70 while the dispenser member is not in use.

Figure 30:
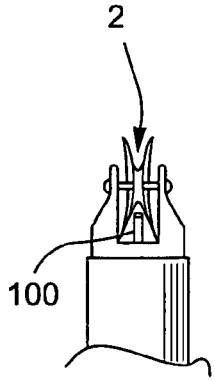

As illustrated in FIG. 30, the massage member 2 may be secured to a receptacle that may be arranged to deliver a composition between the flexible lips, for example, by means of an endpiece 100 including an end opening between the lips, or in proximity of the lips.

The composition deposited in this way may be held by capillarity between the lips, where appropriate or desired.

Before treating a predefined region, a composition may be deposited between the lips, the composition coming from an independent receptacle.

For example, the composition used in association with a massage member may be a cosmetic or a skin care product, for example, an anti-wrinkle agent.

Figure 31:
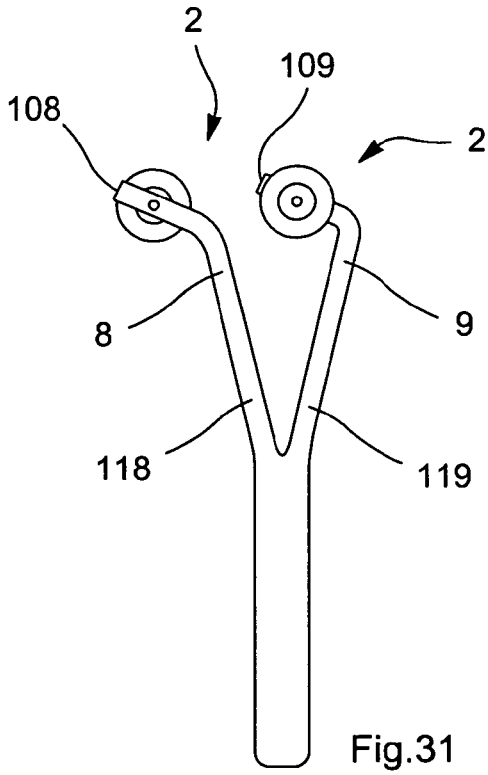

FIG. 31 illustrates the possibility of including branches that include longitudinal axes that are not contained entirely in a single plane.

For example, the branches may include distal portions 108 and 109 that slope out from a plane containing proximal portions 118 and 119. The distal portions may carry massage members.

Figure 32:
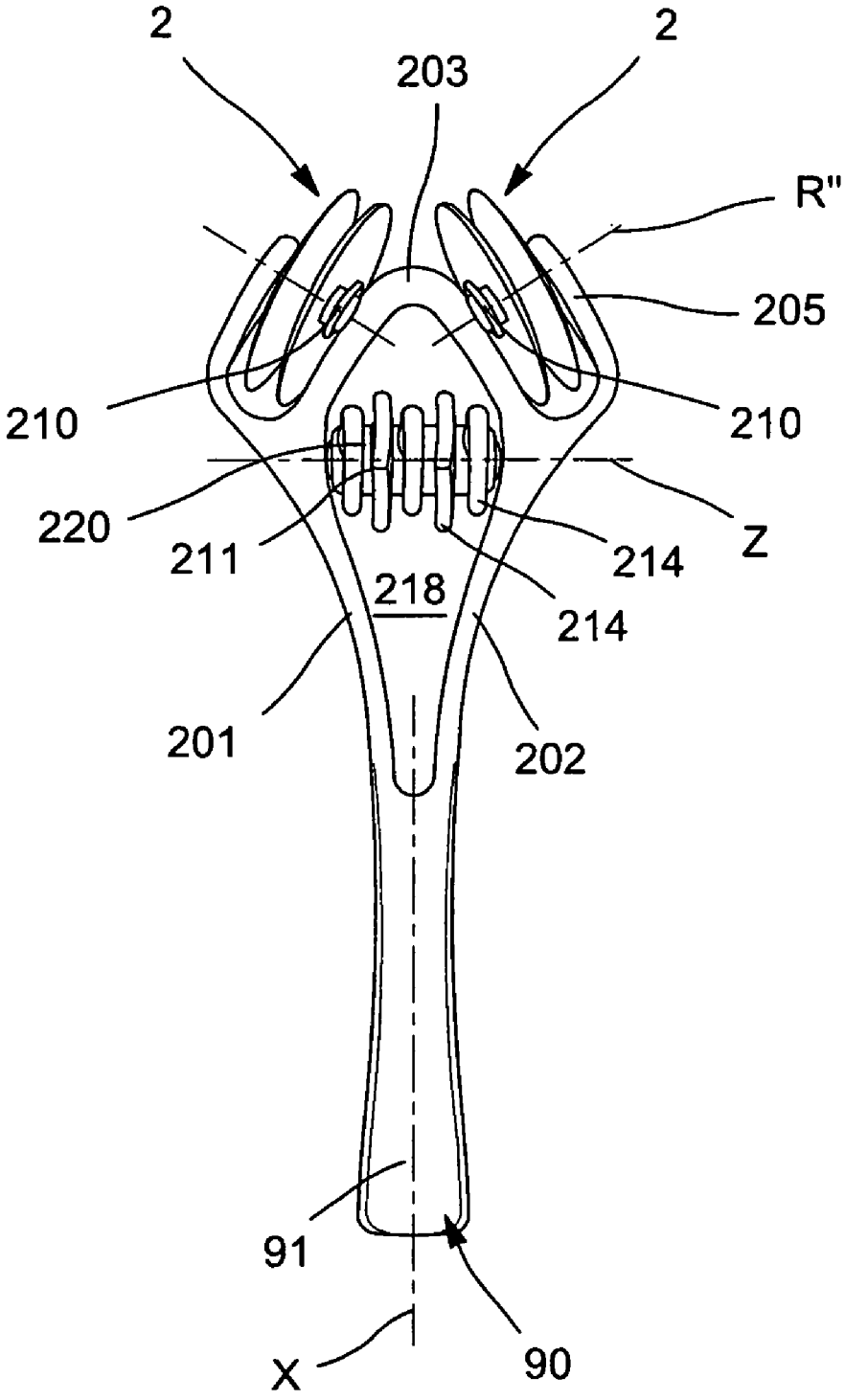
Figure 33:
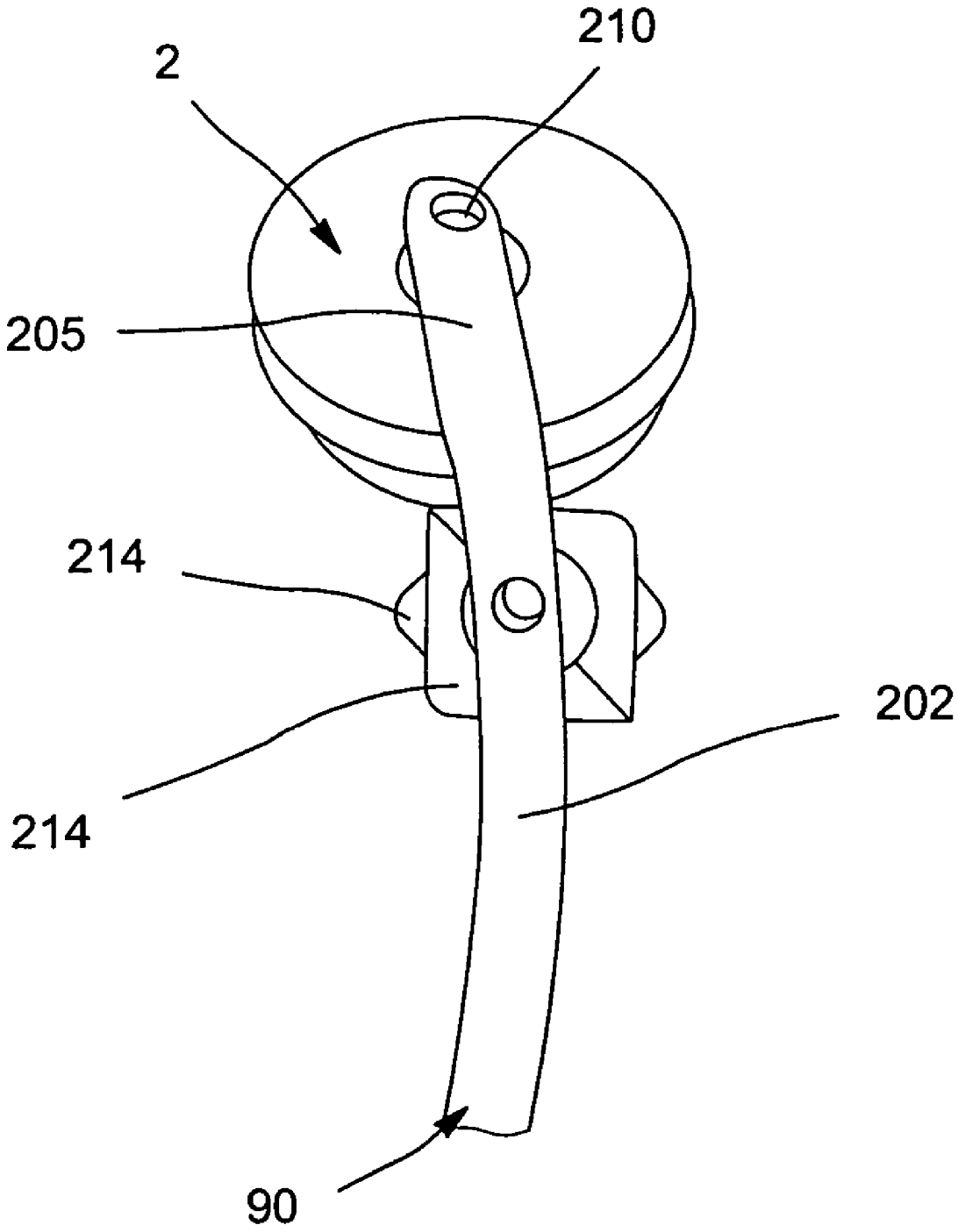
FIG. 33 is a view as seen looking along XXXIII of FIG. 32.

FIGS. 32 and 33 illustrate an exemplary embodiment in which the support 90 may include a handle 91 that is extended by two branches 201 and 202 that are connected together at their end remote from the handle 91 by an arcuate portion 203.

The branches 201 and 202 may include extensions 204 and 205 that cooperate with the arcuate portion 203 to form forks in which two rotary massage members 2 are disposed.

Each of the rotary massage members may include a pair of lips that may be made as a single part by molding elastomer material. The lips may be carried by a hub 210 that includes ends that may be engaged in corresponding holes of the arcuate portion 203 and of the extensions 204 and 205, as illustrated in FIG. 33.

The massage members 2 may turn about respective axes of rotation R' and R" that form between them an obtuse angle.

The extensions 204 and 205 may converge in a direction going away from the handle 91.

The branches 201 and 202 may define between them a gap 218 that receives a roller 211 that may be rotatably mounted relative to the support 90. The roller 211 may include a plurality of ribs 214 that may be spaced-apart along the axis of rotation Z of the roller, and that may define between them grooves 220. Each rib 214 may include a generally square shape when observed along the axis Z. The tops of two adjacent ribs may be offset by 45°, for example.

As illustrated, the support 90 may be made from a relatively rigid plastics material, but it is contemplated that the material may be flexible.

Depending on the side of the device that is selected by the user for bringing the massage members 2 into contact with the skin, the roller 211 may or may not come into contact with the skin.

More particularly, when the user brings the convex side of the handle 91 to face the skin, the roller 211 may come into contact with the skin relatively easily. When the concave side of the handle faces the skin, it may be less easy for the roller 211 to come into contact with the skin.

The invention is not limited to a particular shape of massage member between the branches, and the roller 211 may, for example, include portions in relief including other shapes, for example, spikes.

Figure 34:
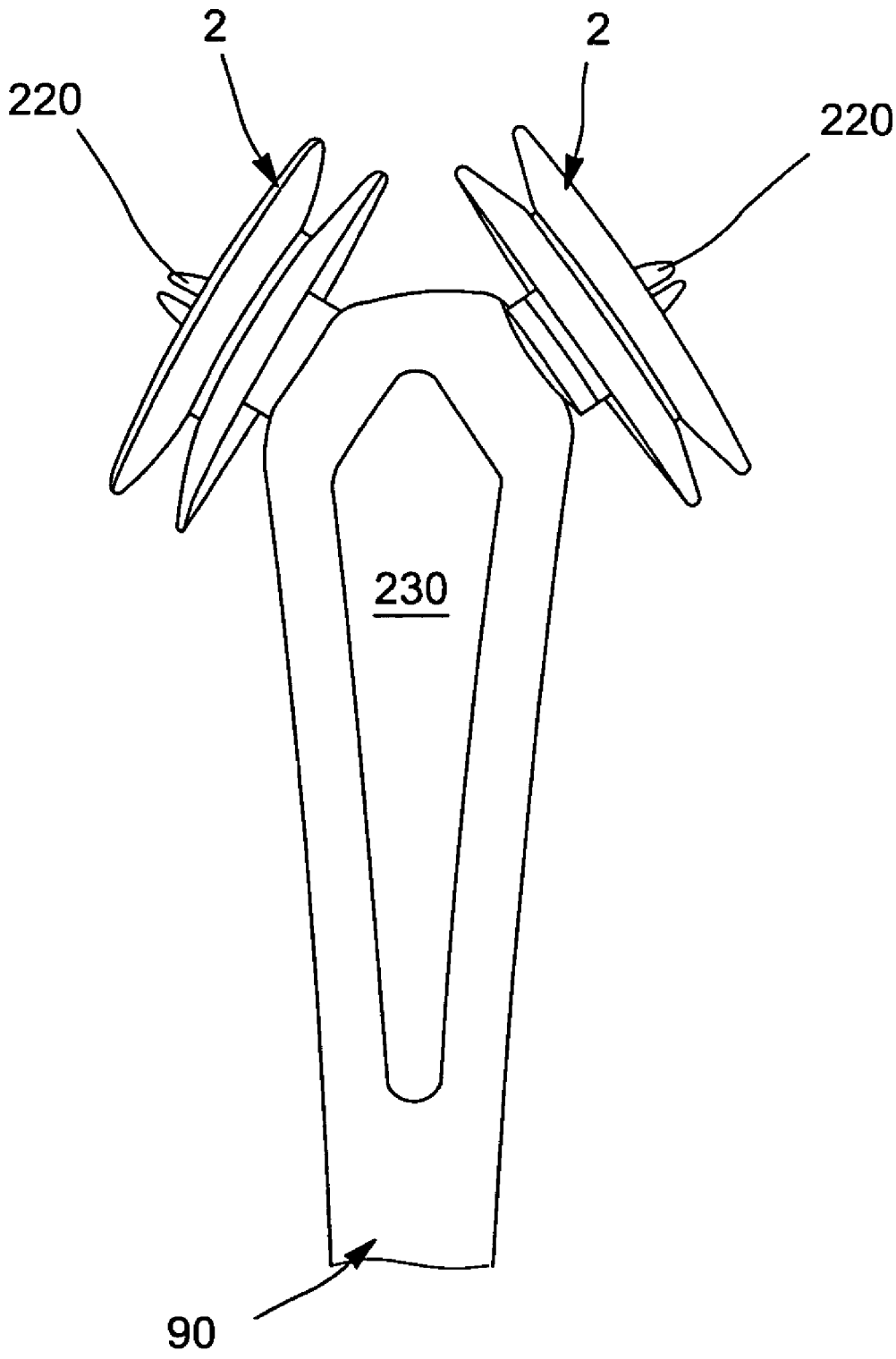
Figure 36:
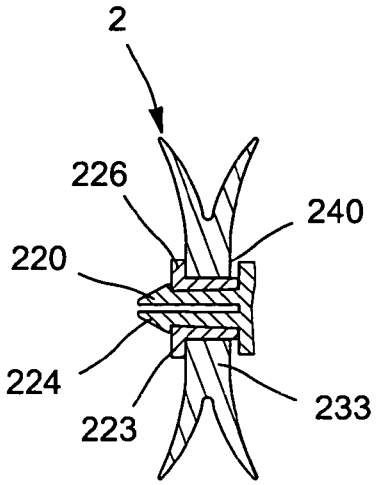
FIG. 36 is an diagrammatic and fragmentary axial cross-sectional view illustrating how a massage member of the device of FIG. 34 may be assembled.

FIG. 34 illustrates an exemplary embodiment in which the massage members 2 may be supported by slotted pins 220 that may be made integrally, i.e., monolithically, with the support 90, or may be fitted on the support, for example, being snap-fastened, force-fitted, adhesively bonded, or heat-sealed in corresponding housings of the support.

The support 90 may include a central opening 230, as illustrated.

Each massage member 2 may be mounted on a ring 223 that may be snap-fastened on the slotted pin 220. On the side of the head 224 of the pin 220, the ring 223 may include a collar 226.

An axial dimension of the ring 223 may be greater than an axial dimension of the central portion 233 of the massage member, such that the face 240 of the massage member, situated on the side remote from the head 224, does not come to bear against the collar 244 that is at the base of the slotted pin 220.

Figure 37:
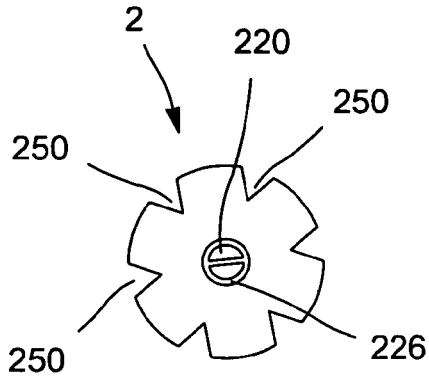
FIGS. 37 to 40 are front views illustrating other exemplary massage members.

A lip of the massage member may include notches 250, as illustrated in FIG. 37.

Figure 38:
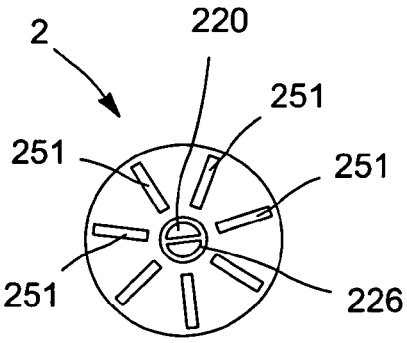

The lip may also include openings 251, as illustrated in FIG. 38, for example, a succession of radial slots.

Figure 39:
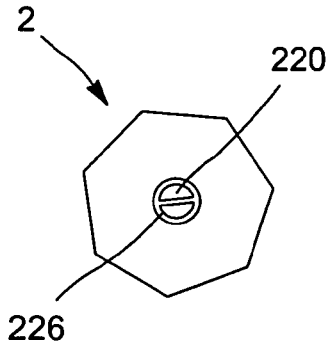
Figure 35:
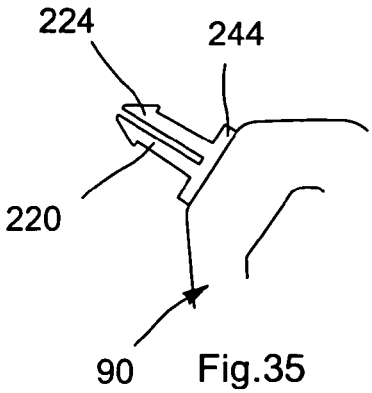
FIG. 35 illustrates a detail of the device of FIG. 34.

The lip illustrated in FIG. 39 may includes a non-circular edge, for example, an edge including a polygonal outline, for example, including more than four sides.

Figure 40:
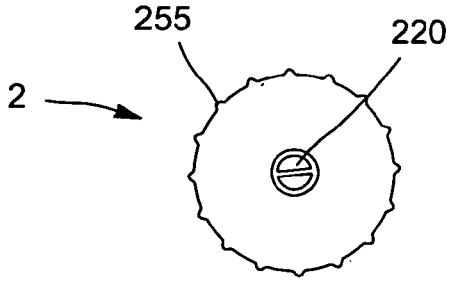

On its edge, the lip may include teeth 255, as illustrated in FIG. 40.

Naturally, any shape of massage member illustrated in FIGS. 37 to 40 may be used, regardless of the way in which the massage member 2 is mounted on the support.

In exemplary embodiments not illustrated, the massage members illustrated in FIGS. 1 to 36 may be replaced by any one of the massage members illustrated in FIGS. 37 to 40.

Naturally, the invention is not limited to the embodiments described above, and, for example, the characteristics of the various embodiments may be combined with one another within exemplarys that are not illustrated.

A single massage device may be used with different massage members selected from any of the massage members illustrated in the figures.

The expression "comprising a" should be understood as being synonymous with "comprising at least one", unless specified to the contrary.

Although various details of the present invention herein include been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A massage device comprising:

at least one support; and at least one massage member rotatably mounted on the support, the massage member comprising at least one pair of flexible lips, each lip of the at least one pair of flexible lips extending annularly about an axis of rotation of the massage member, and being configured to come into engagement with a region to be treated, and to flex when the device is applied to the region to be treated, the lips of each pair flaring apart from each other along a direction away from the axis of rotation.

2. The device according to claim 1, wherein the at least one pair of flexible lips are molded as a single part.

3. The device according to claim 1, wherein the at least one pair of flexible lips are not a single part.

4. The device according to claim 2, wherein the massage member includes at least one pin portion that is molded together with the at least one pair of flexible lips.

5. The device according to claim 1, wherein the massage member includes a hub that comprises a material that is different from a material of the at least one pair of flexible lips.

6. The device according to claim 1, further comprising projecting elements between the at least one pair of flexible lips.

7. The device according to claim 6, wherein the projecting elements comprise a succession of spikes.

8. The device according to claim 6, wherein the projecting elements are monolithic with the at least one pair of flexible lips.

9. The device according to claim 1, wherein at least one lip of the at least one pair of flexible lips includes a circular free edge.

10. The device according to claim 1, wherein at least one lip of the at least one pair of flexible lips includes a non-circular free edge.

11. The device according to claim 1, wherein the at least one pair of flexible lips are substantially symmetrical to each other about a plane that is perpendicular to the axis of rotation.

12. The device according to claim 1, wherein at least one lip of the at least one pair of flexible lips includes a free edge including axial symmetry about the axis of rotation.

13. The device according to claim 1, wherein at least one lip of the at least one pair of flexible lips is off-center.

14. The device according to claim 1, wherein a distance, measured along the axis of rotation, between free edges of the two lips of the at least one pair of flexible lips lies in a range of about 1 mm to about 15 mm.

15. The device according to claim 14, wherein the distance lies in a range of about 2 mm to about 10 mm.

16. The device according to claim 1, wherein a length of the at least one pair of flexible lips, measured between a free edge thereof and a zone at which the at least one pair of flexible lips connect with a remainder of the massage member, lies in a range of about 3 mm to about 15 mm.

17. The device according to claim 16, wherein the length lies in a range of about 4 mm to about 10 mm.

18. The device according to claim 1, wherein a thickness of at least one lip of the at least one pair of flexible lips is not greater than 1.5 mm over at least half of a length thereof.

19. The device according to claim 1, wherein a maximum radius of at least one flexible lip is not greater than 20 mm.

20. The device according to claim 1, further comprising at least first and second massage members, each massage member comprising at least one pair of flexible lips, the first and second massage members being configured to turn about different respective axes of rotation.

21. The device according to claim 20, wherein an angle between the axes of rotation is less than 180°.

22. The device according to claim 20, wherein an angle between the axes of rotation is greater than 180°.

23. The device according to claim 1, wherein the support includes two branches, each branch carrying at least one massage member comprising at least one pair of flexible lips.

24. The device according to claim 23, wherein a length of at least one of the branches is not less than 40 mm.

25. The device according to claim 23, wherein at least one of the branches is elastically deformable.

26. The device according to claim 1, wherein the support includes a receptacle.

27. The device according to claim 1, wherein the support is configured to be fastened in a removable manner on a receptacle.

28. The device according to claim 1, further comprising a protective cap that is configured to be fastened in a removable manner on the support.

29. The device according to claim 1, further comprising a dispenser member configured to dispense a composition between the lips.

30. The device according to claim 2, wherein the at least one pair of flexible lips defines a groove therebetween, the groove widening in a radial direction.

31. The device according to claim 1, further comprising an additional massage member that is mounted between branches of the support, each massage member being supported by the branches.

32. The device according to claim 1, wherein the support includes a flat handle.

33. The device according to claim 1, further comprising at least one slotted pin; and a ring carrying one of the massage members, the ring being snap-fastened on the slotted pin.

34. The device according to claim 33, wherein the pin is fitted on the support.

35. The device according to claim 1, wherein at least one lip of the at least one pair of flexible lips includes openings.

36. A method of massaging skin using a device as defined in claim 1, the method comprising applying the at least one pair of flexible lips to the skin.

37. The method according to claim 36, wherein applying the at least one pair of flexible lips to the skin comprises applying the at least one pair of flexible lips on either side of a wrinkle; and rolling the massage member over the skin to turn the massage member.

38. The method according to claim 36, further comprising exerting tension by applying the massage device on either side of at least one wrinkle.

39. The method according to claim 38, further comprising displacing the massage device along the wrinkle.

40. The method according to claim 36, further comprising depositing a composition between the at least one pair of flexible lips at least one of prior to and during a displacement of the massage member over the skin.

* * * * *